US007989742B2

(12) United States Patent
Bredy

(10) Patent No.: US 7,989,742 B2
(45) Date of Patent: Aug. 2, 2011

(54) PROCESS TO CONTROL THE INITIATION OF AN ATTACK MODULE AND INITIATION CONTROL DEVICE IMPLEMENTING SAID PROCESS

(75) Inventor: Thierry Bredy, Saint-Doulchard (FR)

(73) Assignee: Nexter Munitions, Versailles (FR)

( * ) Notice: Subject to any disclaimer, the term of this patent is extended or adjusted under 35 U.S.C. 154(b) by 226 days.

(21) Appl. No.: 12/213,927

(22) Filed: Jun. 26, 2008

(65) Prior Publication Data

US 2009/0001215 A1 Jan. 1, 2009

(30) Foreign Application Priority Data

Jun. 27, 2007 (FR) ..... 07 04613

(51) Int. Cl.
*F42C 21/00* (2006.01)
*F42C 15/00* (2006.01)
*F42B 15/00* (2006.01)

(52) U.S. Cl. ..... 244/3.1; 102/200; 102/206; 102/221; 89/1.11; 701/1; 701/3; 701/200; 701/207; 701/213

(58) Field of Classification Search ..... 244/3.1–3.3; 89/1.11; 342/61–68, 175, 195, 357.01–357.17; 701/1–18, 200, 207–224; 102/200, 206, 102/215–221
See application file for complete search history.

(56) References Cited

U.S. PATENT DOCUMENTS

| | | | | |
|---|---|---|---|---|
| 4,277,038 | A | 7/1981 | Yates et al. | |
| 4,356,770 | A | 11/1982 | Atanasoff et al. | |
| 4,858,532 | A | 8/1989 | Persson et al. | |
| 4,934,269 | A * | 6/1990 | Powell | 102/221 |
| 5,637,826 | A * | 6/1997 | Bessacini et al. | 244/3.11 |
| 5,760,737 | A * | 6/1998 | Brenner | 342/357.02 |
| 5,841,059 | A | 11/1998 | Laurend et al. | |
| 5,881,969 | A * | 3/1999 | Miller | 244/3.17 |
| 5,886,286 | A * | 3/1999 | Will et al. | 102/216 |
| 6,142,411 | A * | 11/2000 | Cobleigh | 244/3.14 |
| 6,234,082 | B1 | 5/2001 | Cros et al. | |
| 6,250,229 | B1 | 6/2001 | Kerdraon et al. | |
| 6,796,213 | B1 * | 9/2004 | McKendree et al. | 89/1.11 |
| 6,886,774 | B2 | 5/2005 | Lamorlette | |
| 6,896,220 | B2 * | 5/2005 | McKendree et al. | 244/3.15 |
| 7,207,517 | B2 * | 4/2007 | McKendree et al. | 244/3.15 |
| 7,367,525 | B2 * | 5/2008 | McKendree et al. | 244/3.15 |
| 2004/0245369 | A1 * | 12/2004 | McKendree et al. | 244/3.15 |
| 2006/0038056 | A1 * | 2/2006 | McKendree et al. | 244/3.15 |
| 2006/0108468 | A1 * | 5/2006 | McKendree et al. | 244/3.15 |
| 2006/0289694 | A1 | 12/2006 | Bredy | |
| 2007/0028791 | A1 | 2/2007 | Bredy | |

FOREIGN PATENT DOCUMENTS

EP 0 800 054 A1 10/1997

(Continued)

*Primary Examiner* — Bernarr E Gregory
(74) *Attorney, Agent, or Firm* — Oliff & Berridge, PLC

(57) ABSTRACT

The invention relates to a process to control the initiation of an attack module, such as a projectile or sub-projectile, such attack module having at least one pre-determined direction of action. Before firing or on trajectory, the coordinates of at least one target are programmed into a fixed terrestrial reference, the orientation of the direction(s) of action in the fixed terrestrial reference is determined at least once on trajectory, and the initiation of the attack module is only authorized if the direction of action is oriented in the direction of the target. The invention also relates to the device implementing such a process.

13 Claims, 6 Drawing Sheets

FOREIGN PATENT DOCUMENTS

| | | | |
|---|---|---|---|
| EP | 0 807 798 | A1 | 11/1997 |
| EP | 0 905 473 | A1 | 3/1999 |
| EP | 1 045 222 | A2 | 10/2000 |
| EP | 1 617 165 | A1 | 1/2006 |
| EP | 1 719 969 | A1 | 11/2006 |
| FR | 2 793 314 | A1 | 11/2000 |
| FR | 2 847 033 | A1 | 5/2004 |
| GB | 2 090 950 | A | 7/1982 |

* cited by examiner

PROCESS TO CONTROL THE INITIATION OF AN ATTACK MODULE AND INITIATION CONTROL DEVICE IMPLEMENTING SAID PROCESS

BACKGROUND OF THE INVENTION

1. Field of the Invention

The technical scope of the invention is that of devices to initiate an attack module which has at least one predetermined direction of action.

2. Description of the Related Art

By attack module having a predetermined direction of action, we mean a projectile or sub-projectile which acts preferentially in a given direction in space.

This is the case for projectiles or sub-projectiles incorporating a shaped charge (hollow charge or explosively-formed charge). In this case, the direction of action is that in which the slug or jet of the shaped charge is projected. By way of an example, patent FR2793314 (or U.S. Pat. No. 6,250,229) discloses a known sub-projectile with an explosively-formed charge.

It is also the case for projectiles or sub-projectiles which are splinter-forming and are designed so as to project splinters in a given mean direction. It is known, for example, to replace the charge liner of an explosively-formed charge by a case enclosing preformed splinters.

When this charge is ignited it projects a spray of splinters in a given direction which is that of the charge axis. The splinters disperse slightly around the projection axis resulting in an impact surface on a target which is of a given area (depending on the distance between charge and target). Patent EP1045222 (no known U.S. patent equivalent) discloses such a charge which projects splinters in a given direction.

Projectiles or sub-projectiles which thus have a predetermined direction of action are particularly advantageous in that they enable the danger zone to be controlled. Collateral damage can be minimized, with only the main target in principle being destroyed.

These attack modules thereby enable the effects to be restricted to a well-defined sector which was not the case for classical projectiles or sub-projectiles, for example explosive artillery shells which generate splinters in all directions in the space surrounding the shell axis.

One of the problems posed by attack modules having a predetermined direction of action is, however, that they have to be oriented in the direction of the required target.

Thus, projectiles are known which are brought into contact or into the vicinity of the target, either by direct fire (shaped charge shells fired in direct fire with no guidance) or by indirect fire.

In the case of indirect fire, it is however necessary for guidance and steering means to be provided which enable the projectile to be directed onto the target, for example orientable fins controlled by a homing device. Reference may be made to patents EP905473 (or U.S. Pat. No. 6,234,082) or FR2847033 (or U.S. Pat. No. 6,886,770 which disclose such guided projectiles.

Sub-projectiles are also known which do not have steering means but which are known to scan a zone of ground using a target detector (for example and infra-red sensor). In this case, firing is initiated when the sub-projectile detects a target presenting the required outline characteristics. Patents GB2090950 and U.S. Pat. No. 4,858,532 disclose such known sub-projectiles.

These sub-projectiles with no steering means nevertheless still suffer from certain drawbacks.

They are firstly only able to attack targets which have a well-defined and easily recognizable signature. They are therefore not able to be used against targets that are more difficult to detect.

Furthermore, with these sub-projectiles there still remains the risk of inadvertent ignition by false targets (decoys or else targets which have already been hit by another sub-projectile) or by friendly targets.

SUMMARY OF THE INVENTION

The aim of the invention is to propose a device to initiate an attack module (such as a projectile or sub-projectile) which improves the control of the danger zone.

The device according to the invention may be implemented with projectiles or sub-projectiles which do not have steering means or target detection means, thereby enabling the vulnerability of such projectiles or sub-projectiles to scrambling or masking to be reduced.

The device nevertheless ensures these projectiles or sub-projectiles of complete control over the dimensions of the danger zone.

The device may also be implemented in a projectile or sub-projectile which is already provided with detection means.

In this case, the invention provides an additional firing condition which improves the overall control of the area of effectiveness of the attack modules. Any inadvertent initiation may thus be avoided and/or a well defined attack zone enforced.

Thus, the invention relates to a process to control the initiation of an attack module, such as a projectile or sub-projectile, such attack module having at least one pre-determined direction of action, such process wherein it has the following steps:

before firing or on trajectory, the coordinates of at least one target are programmed into a fixed terrestrial reference, the orientation of the direction(s) of action in the fixed terrestrial reference is determined at least once on trajectory, the initiation of the attack module is only authorized if the direction of action is oriented in the direction of the target.

Advantageously, the determination of the orientation of the direction of action with respect to the fixed terrestrial reference will be made by measuring the orientation of the attack module with respect to at least two components of the terrestrial magnetic field, the components of the terrestrial magnetic field being previously known in the fixed terrestrial reference.

Furthermore, a measurement of an attack module/target distance can be made based on the coordinates of the target in the fixed terrestrial reference, programmed before firing or on trajectory, and measurements may be made of the coordinates of the attack modules in the fixed terrestrial reference, such measurements being made on trajectory by a satellite positioning system or else transmitted to the attack module by a platform having trajectography means.

More particularly, to adapt the invention to a projectile with a non-vertical trajectory, the coordinates of the attack module/target vector are calculated on trajectory and in a fixed terrestrial reference, such computation being made from the pre-programmed coordinates of the target as well as those measured of the attack module and using a tri-axial magnetic compass the orientation of the direction of action of the attack module is determined in a fixed terrestrial reference.

To determine the orientation of the direction of action of the attack module in a fixed terrestrial reference, the coefficients of a transition matrix from a reference linked to the attack module, to a fixed terrestrial reference, these components being calculated by associating, for the points of the trajectory under consideration, the measurement of the components of the terrestrial magnetic field in a reference linked to the attack module and the values of the components of the magnetic field in the terrestrial reference, the latter values being known and pre-programmed in the attack module, the indetermination of the computation being lifted by the determination of at least one direction in the terrestrial reference of one of the axes of a reference linked to the attack module.

To lift the indetermination, the orientation of the longitudinal axis of the attack module will be calculated from a computation of the projectile's angle of incidence, such computation being made using measurements of the trajectory followed, the velocity in the terrestrial reference, as well as the knowledge of the aerodynamic transfer function of the projectile.

To adapt the invention to a sub-projectile scattered above a zone of ground by a carrier and to which a downward movement following a substantially vertical axis and a spin movement around the descending vertical axis have been imparted, the direction of action is inclined with respect to the vertical axis of a given angle, the orientation of the direction of action in the terrestrial reference will be determined using the measurement of the components of the magnetic field in a horizontal plane, such plane defined by two magnetic sensors carried by the attack module, the orientation of the direction of attack with respect to this plane being known and the orientation of the magnetic field in the fixed terrestrial reference also being known.

According to one variant, target detection means may also be implemented in the attack module and the attack module will only be initiated if the conditions for authorization have been fulfilled and a target has effectively been detected.

The invention also relates to an initiation control device for an attack module which has at least one pre-determined direction of action, and which implements such a process.

This device is characterized in that it comprises means enabling the coordinates in a fixed terrestrial reference of at least one target to be memorized, means enabling the coordinates of the attack module to be measured in the fixed terrestrial reference, as well as computation means enabling the orientation on trajectory of the direction of action of the attack module in the fixed terrestrial reference to be determined, means to initiate the attack module being coupled with the computation means so as to authorize initiation only if the direction of action is oriented in the direction of the target.

The means to measure the coordinates of the attack module in the fixed terrestrial reference may comprise a GPS receiver and/or a receiver for location data transmitted by a remote platform.

The device may comprise at least two fixed magnetic sensors to determine the orientation of the direction of action of the attack module with respect to the terrestrial magnetic field, memory means supplying the components of the terrestrial magnetic field in the fixed terrestrial reference.

When it is more particularly adapted to a projectile with a non-vertical trajectory, the device is characterized in that the attack module incorporates at least three magnetic sensors and memory means enabling the values of the terrestrial magnetic field in a fixed terrestrial reference to be known for the different points of the trajectory, computation means to determine the orientation of the reference linked to the attack module with respect to the terrestrial reference using the different values of the terrestrial magnetic field, as well as the coordinates of the attack module/target vector in a fixed terrestrial reference, and those of the direction of attack of the attack module.

When it is more particularly adapted to a sub-projectile intended to be scattered above a zone of ground by a carrier and which has a downward movement after scattering with a substantially vertical axis as well as a spin movement around this vertical axis (the direction of action moreover being inclined with respect to the vertical axis of a given angle), the device is characterized in that the attack module incorporates at least two magnetic sensors arranged along two axes of a reference linked to the attack module, the two axes defined by these sensors thereby determining a plane which will be perpendicular to the planned vertical fall axis, the orientation of the direction of action of the attack module with respect to this horizontal plane being known.

BRIEF DESCRIPTION OF THE DRAWINGS

The invention will become more apparent from the following description of the different embodiments, such description being made with reference to the appended drawings, in which.

DETAILED DESCRIPTION OF PREFERRED EMBODIMENTS

Figure 1:
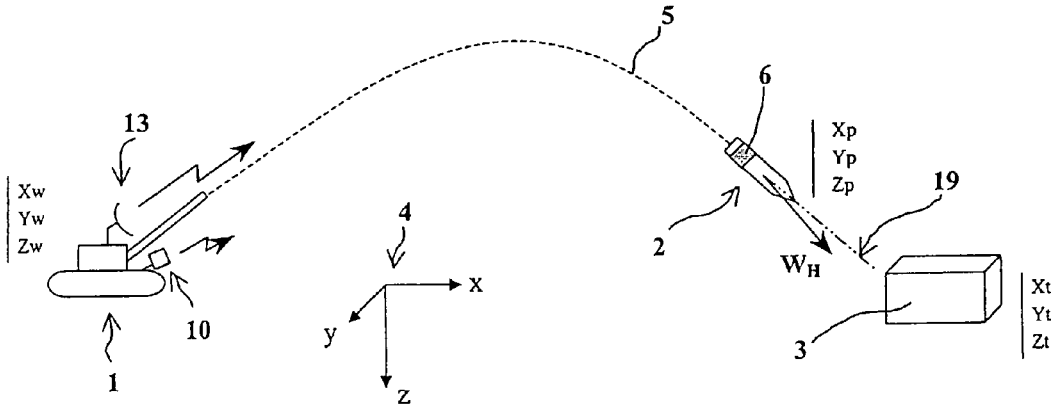
FIG. 1 schematizes the implementation of an attack module according to a first embodiment of the invention from a land platform.

FIG. 1 shows a weapon system or firing platform 1 (here a self-propelled artillery gun) which is firing a projectile 2 at a target 3 to destroy it. This projectile 2 constitutes an attack module with a pre-determined direction of action $W_H$ which here forms an angle with axis 19 of the projectile 2.

The latter follows a ballistic trajectory 5 and is spinning around its axis.

FIG. 1 shows a fixed terrestrial reference 4 with axes XYZ. In this reference, the coordinates of the firing platform 1 are $X_wY_wZ_w$, the coordinates of the projectile 2 are $X_pY_pZ_p$, and those of the target 3 are $X_tY_tZ_t$.

For the sake of clarity, hereafter we will refer to point coordinates (target, platform, projectile). Naturally, the targets under aim occupy a certain surface area on the ground and the target point corresponds, for example, to the barycentre of the actual target. Similarly, the projectile's coordinates are, for example, those of its centre of gravity, or else those of the seat of its warhead.

The following explanation is based on theoretical geometric considerations. Someone skilled in the art will easily adapt the principles which will be described to deal with the particular cases of actual attack modules.

The attack module 2 incorporates a device 6 to initiate it. This device ensures that the initiation will only occur when the conditions are optimal, such conditions enabling collateral damage to be avoided.

The attack module 2 may incorporate one or several shaped charges (not shown) which will be projected in a direction of action $W_H$. It may thus incorporate a charge projecting a spray of splinters in mean direction $W_H$.

This explanation will restrict itself to the case of a single mean direction of action $W_H$. A splinter charge projects splinters in a substantially conical spray centered on this direction of action. The principles which will be described may easily be applied to the determination of the surfaces attained at ground level and to the comparison of this theoretically attained area with the overall (known and programmed) occupation on the ground of a target to be engaged.

The pyrotechnic means ensuring the terminal effect (firing of a shaped charge or projection of splinters) do not form the subject of the present invention and will not be described in detail.

These means are well known to someone skilled in the art.

Figure 2:
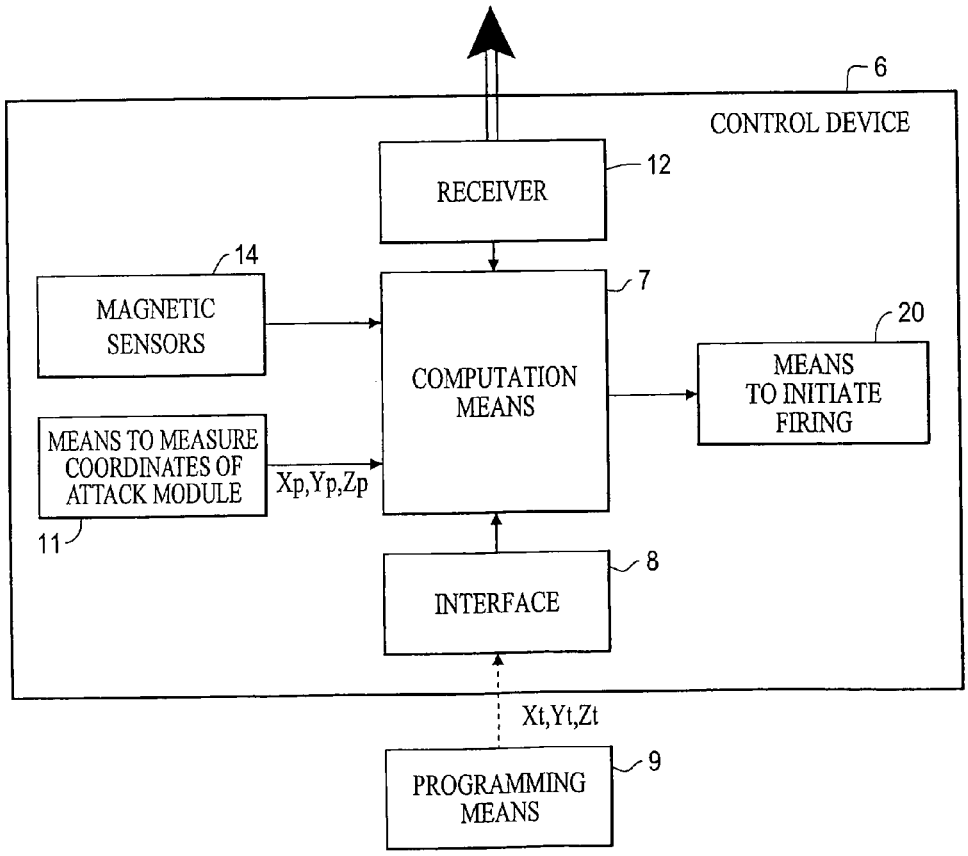
FIG. 2 is a block diagram of the initiation device according to the invention.

FIG. 2 schematically shows the structure of the control device 6. This device essentially comprises computation means 7 which incorporate different computation means made in the form of algorithms that are memorized or recorded.

These computation means 7 are linked to means 20 to initiate the firing of the pyrotechnic charge of the attack module 2 (for example, an electronic fuse causing a detonator to ignite). These known means are not the subject of the present invention and will therefore not be described in detail.

The control device 6 also incorporates memory or register means (incorporated into the computation means 7) to memorize the coordinates $X_tY_tZ_t$ of at least one target 3 in the fixed terrestrial reference 4.

The coordinates of the target(s) 3 are introduced into the computation means 7 by means of a suitable interface. They are supplied by programming means 9 integral with the firing platform 1.

These coordinates may, for example, be programmed before firing using the electrical contacts on the platform 1 and linked to the programming means 9. Programming may also be performed by an inductive coupling associating a fixed induction loop integral with the platform 1, such loop intended to cooperate with another loop on the projectile 2.

The coordinates may also be transmitted to the projectile 2 on its trajectory using transmitter means 10 integral with the platform 1 (for example, a transmitter of wireless signals). The interface 8 will, in this case, comprise a receiver antenna (not shown).

According to one characteristic of the invention, the device 6 also comprises means 11 to measure the coordinates $X_pY_pZ_p$ of the attack module in the fixed terrestrial reference 4. These means 11 may be constituted by a receiver of a satellite positioning system (or GPS).

Alternatively, the GPS receiver onboard the projectile 2 may be replaced by a simple receiver 12 for signals supplied by a transmitter 10 (identical to or separate from the one previously mentioned) and integral with the platform 1. This transmitter 10 will, in this case, be coupled with trajectography means 13 also integral with the platform.

The device according to the invention also comprises fixed magnetic sensors 14 (for example, magnetoresistors). These sensors enable the components of the terrestrial magnetic field to be measured along two or three axes of a reference linked to the projectile 2.

Measuring the components of the terrestrial magnetic field will enable, by means of appropriate algorithms, the reference linked to the projectile to be positioned with respect to the terrestrial reference 4.

Furthermore, the computation means 7 also incorporate memory or register means to memorize the components of the terrestrial magnetic field H in a fixed terrestrial reference 4 and at all points of the trajectory 5 planned for the projectile 2.

Figure 3:
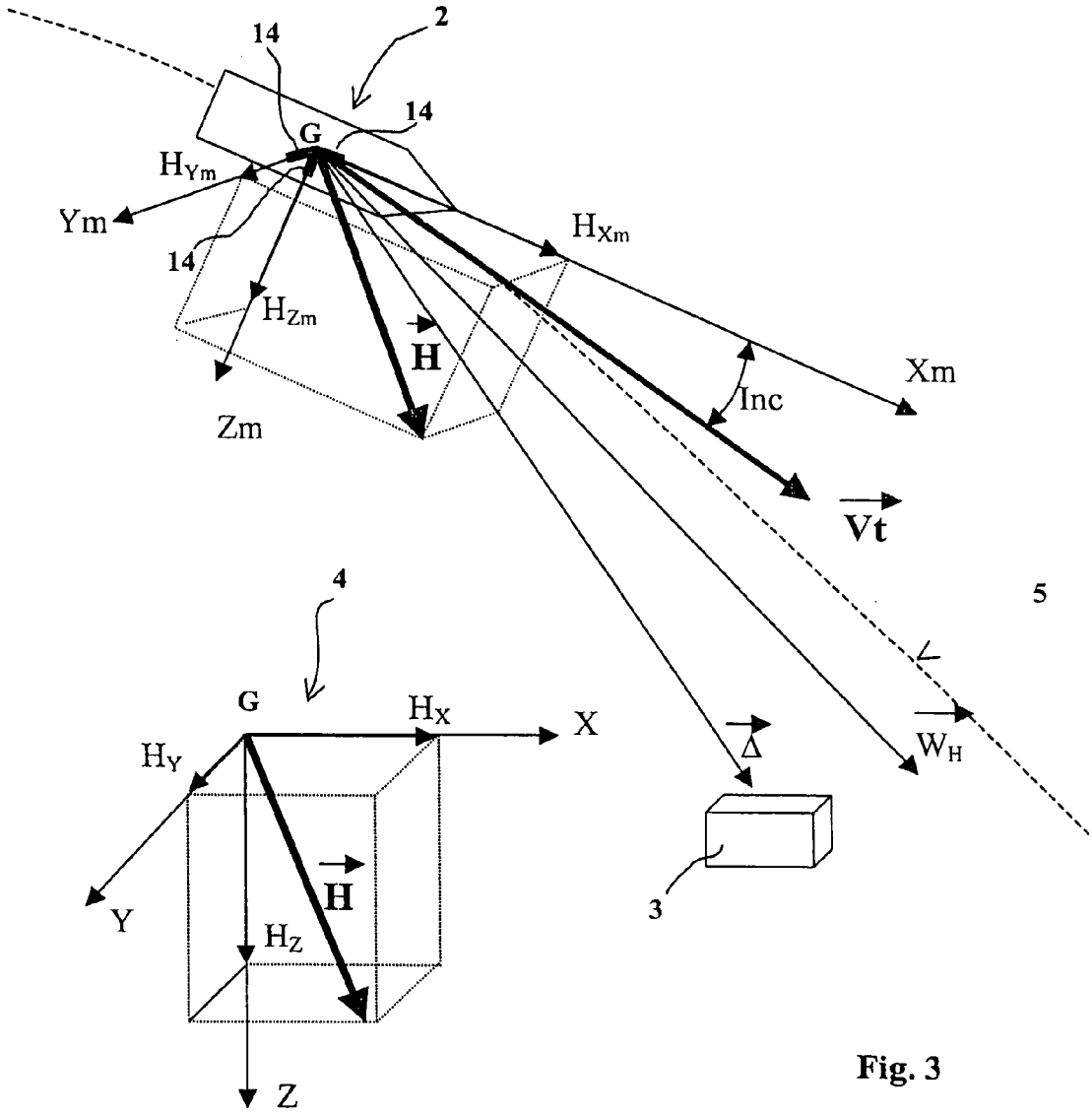
FIG. 3 shows the different axes, angles and vectors for an attack module constituted by a projectile with a ballistic trajectory.

FIG. 3 shows the projectile 2 equipped with three magnetic sensors 14 which define the axes $GX_mY_mZ_m$ of a reference (here, orthonormed) linked to the projectile 2.

The magnetic field H has thus, in this reference linked to the projectile, the three components $H_{Xm}$, $H_{Ym}$ and $H_{Zm}$ which are measured along the trajectory 5.

Furthermore, the same magnetic field H in the fixed terrestrial reference 4, positioned at point G of the trajectory 5, has components $H_x$, $H_y$ and $H_z$.

The vector Vt is the velocity vector of the projectile 2 on its trajectory 5. The components of this vector in the fixed reference 4 as well as the coordinates of point G where the projectile 2 is located are known thanks to the positioning means 11 (or to the trajectography means).

Since the coordinates of point G are known on the trajectory and the coordinates of the target 3 have already been programmed, the computation means 7 may thus at any time calculate, in the fixed terrestrial reference 4, the coordinates of the vector Δ which links the attack module 2 to the target 3 (vector whose norm expresses the distance from the attack module to the target).

FIG. 3 shows vector $W_H$ which is the one defining the direction of action of the projectile (or attack module) 2. This direction of action $W_H$ is a fixed datum in the reference XmYmZm linked to the projectile. This datum is determined by the construction of the projectile 2. For a given projectile or attack module, how to place the magnetic sensors 14 with respect to the warhead is known and the warhead's direction of action with respect to the projectile body 2 is also known. The coordinates of vector $W_H$ in the reference linked to the projectile 2 are memorized in the computation means 7.

In accordance with the invention, the orientation of this direction of action $W_H$ in the fixed terrestrial reference 4 will be determined on trajectory.

Furthermore, the distance between the attack module and target, which is the norm of vector Δ will be determined by computation.

Thereafter, the attack module 2 will be authorized to ignite if the direction of attack $W_H$ is oriented in the direction of the target 3, that is to say if the vectors $W_H$ and Δ are collinear and in the same direction, and if additionally the distance between the attack module 2 and the target 3 is less than or equal to the attack module's radius of action.

Indeed, known attack modules (incorporating shaped charges or focused splinter charges) have an effectiveness which depends on the distance separating them from their target at the time of their ignition. It is pointless initiating them at an excessive distance. The norm of vector Δ merely has to be verified to be less than or equal to a programmed value which is the radius of action Ra of the attack module in question and which corresponds to a convenient distance to control ignition with respect to a target.

We note that in the case of an attack module being implemented that has a large distance of action (for example, of between 200 meters and 500 meters) it will be possible for firing to be initiated when the collinearity (in the same direction) of vectors $W_H$ and Δ is ensured (without any verification of the norm of Δ with respect to a radius of action).

Indeed, the probability of these vectors being collinear at a distance of more than 500 meters is almost inexistent during the flight of a projectile following a ballistic trajectory.

Attack modules having a great distance of action are, for example, those fitted with explosively formed charges.

Figure 4:
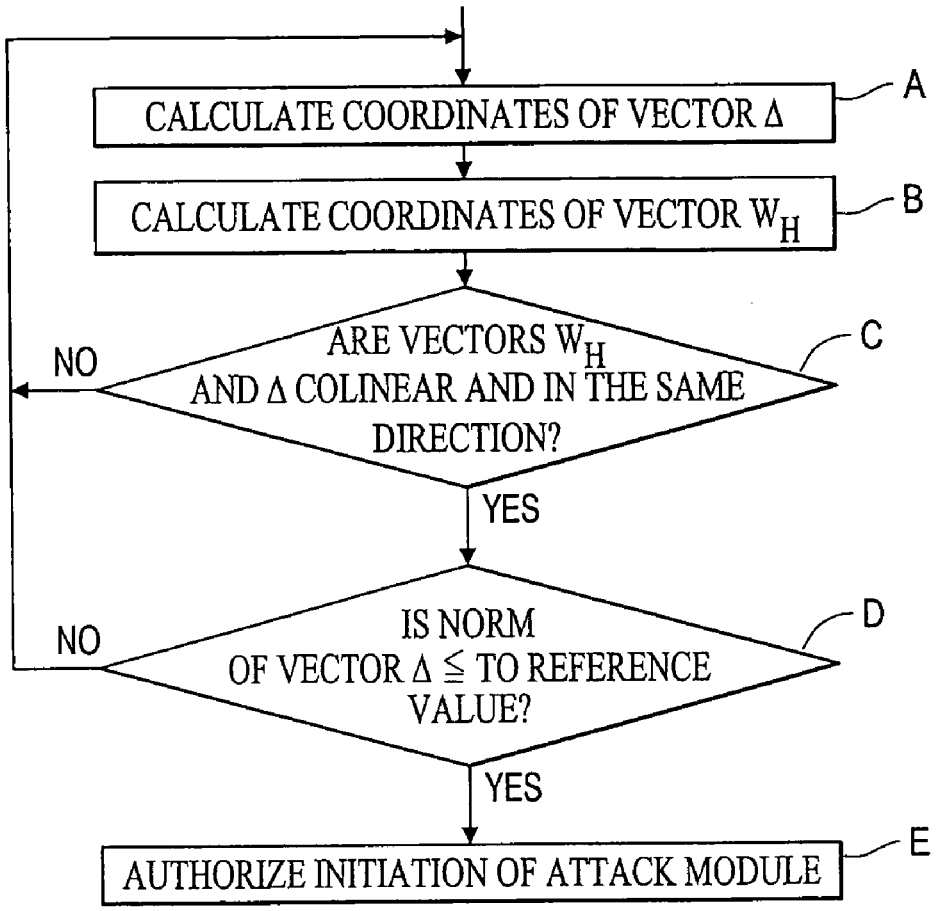
FIGS. 4 and 5 are logical diagrams summarizing the main steps of the process according to the invention.

FIG. 4 is a logical diagram which summarizes the main steps of the process according to the invention.

Step A corresponds to the calculation of the coordinates of vector Δ in the fixed terrestrial reference 4 (attack module/target distance vector). The norm of this vector Δ will be calculated during this same step.

Step B corresponds to the calculation of the coordinates of vector $W_H$ (the orientation of the direction of action) in the fixed terrestrial reference 4. This calculation implements the steps which will be explained hereafter.

Test C verifies the collinearity and the same direction of vectors $W_H$ and Δ.

Test D verifies (if necessary) that the norm of vector Δ is less than or equal to a reference value (radius of action Ra).

When the two tests are conclusive, step E corresponds to the authorization to initiate the attack module 2.

If one or other of the tests is negative, the calculation steps continues (steps A and B).

The range of tests C and D is naturally without consequence and steps A and B may be conducted simultaneously.

According to one characteristic of the process according to the invention, during step B the orientation of the direction of action $W_H$ with respect to the fixed terrestrial reference 4 will be determined by measuring the orientation of the attack module 2 with respect to at least two components of the terrestrial magnetic field.

FIG. 3 shows that, to know the orientation of vector $W_H$ in the fixed terrestrial reference 4, it is enough to know the orientation of the reference $GX_mY_mZ_m$ linked to the projectile 2 with respect to the fixed terrestrial reference 4 (the orientation of $W_H$ in the reference linked to the projectile 2 is in fact fixed and known).

The calculations of the transition from a mobile reference to a fixed reference implement Euler angles which are well known to the Expert. They enter into the determination of the coefficients of a transition matrix T enabling the calculation of the coordinates of points or vectors in the fixed reference from known coordinates in the mobile reference linked to the projectile 2.

The relation may thus be written as follows:

$$(H_x, H_y, H_z) = T.(H_{Xm}, H_{Ym}, H_{Zm})$$

$(H_x, H_y, H_z)$ being the coordinates of the terrestrial magnetic field vector in the fixed reference and $(H_{Xm}, H_{Ym}, H_{Zm})$ being the coordinates of this same vector in the reference linked to the projectile.

The coefficients of matrix T (and thus the Euler angles) naturally depend on the attitude of the projectile 2 on trajectory, thus on the flight conditions. They vary on trajectory and must be determined continually (or periodically).

In the field of missiles or aeronautics, these Euler angles and the coefficients of the transition matrix T are determined using inertial systems associating gyrometers and accelerometers, which are fragile and costly pieces of equipment (which can not withstand being fired from a gun).

In the process according to the invention, known and preprogrammed values $(H_X, H_Y, H_Z)$ of the components of the magnetic field on the different points of the planned trajectory 5 as well as the values $(H_{Xm}, H_{Ym}, H_{Zm})$ measured thanks to the sensors 14 will be used to calculate the coefficients of the transition matrix T.

As a first approximation for usual artillery ranges, the components of the terrestrial magnetic field may be considered as constant over the whole trajectory 5 of the projectile 2 and during the flight time.

Mathematically, it can be shown that the calculation of the coefficients of the matrix T can not be solved in this way if a matching characteristic of the reference linked to the projectile 2 is not known. Indeed, there is an infinite number of combinations of Euler angles enabling the equation $(H_X, H_Y$ and $H_Z)=T.(H_{Xm}, H_{Ym}, H_{Zm})$ to be solved.

In accordance with the invention, this indetermination will be solved by calculating the orientation of the axis GXm of the reference linked to the projectile 2.

For axis GXm the axis 19 of the projectile 2 itself will be chosen and a classical calculation of flight mechanics will be used to determine the orientation of this axis in the fixed terrestrial reference 4.

It is, in fact, possible, thanks to the GPS positioning means 11 (or to the trajectography means) to know the coordinates of the velocity vector Vt associated with the different points of the trajectory 5 in the terrestrial reference.

Classical flight mechanics equations for a projectile enable the coordinates of the projectile axis (vector GXm) with respect to those of the velocity vector Vt to be calculated in the terrestrial reference.

Indeed, knowing the trajectory 5 and the velocity Vt enables the curve of the trajectory and the acceleration to which the projectile 2 is subjected to be known. The projectile 2 moreover posses an aerodynamic transfer function Fta which depends on its geometry, its mass and its inertial matrix which is fixed by its construction.

The implementation of aerodynamic and flight mechanics equations enables the angle of incidence Inc separating the vectors Vt and GXm to be determined from the transfer function Fta and the acceleration components calculated on trajectory. This angle Inc is a resultant angle of incidence measured in the plane of vectors Vt and GXm, such plane being perpendicular to the instantaneous spin vector of the projectile on its trajectory.

As a first approximation, in certain cases it is possible to consider the angle Inc as nil (vector Vt collinear to axis GXm).

These calculations are well known to someone skilled in the art and it is therefore unnecessary to explain them in further detail here.

Figure 5:
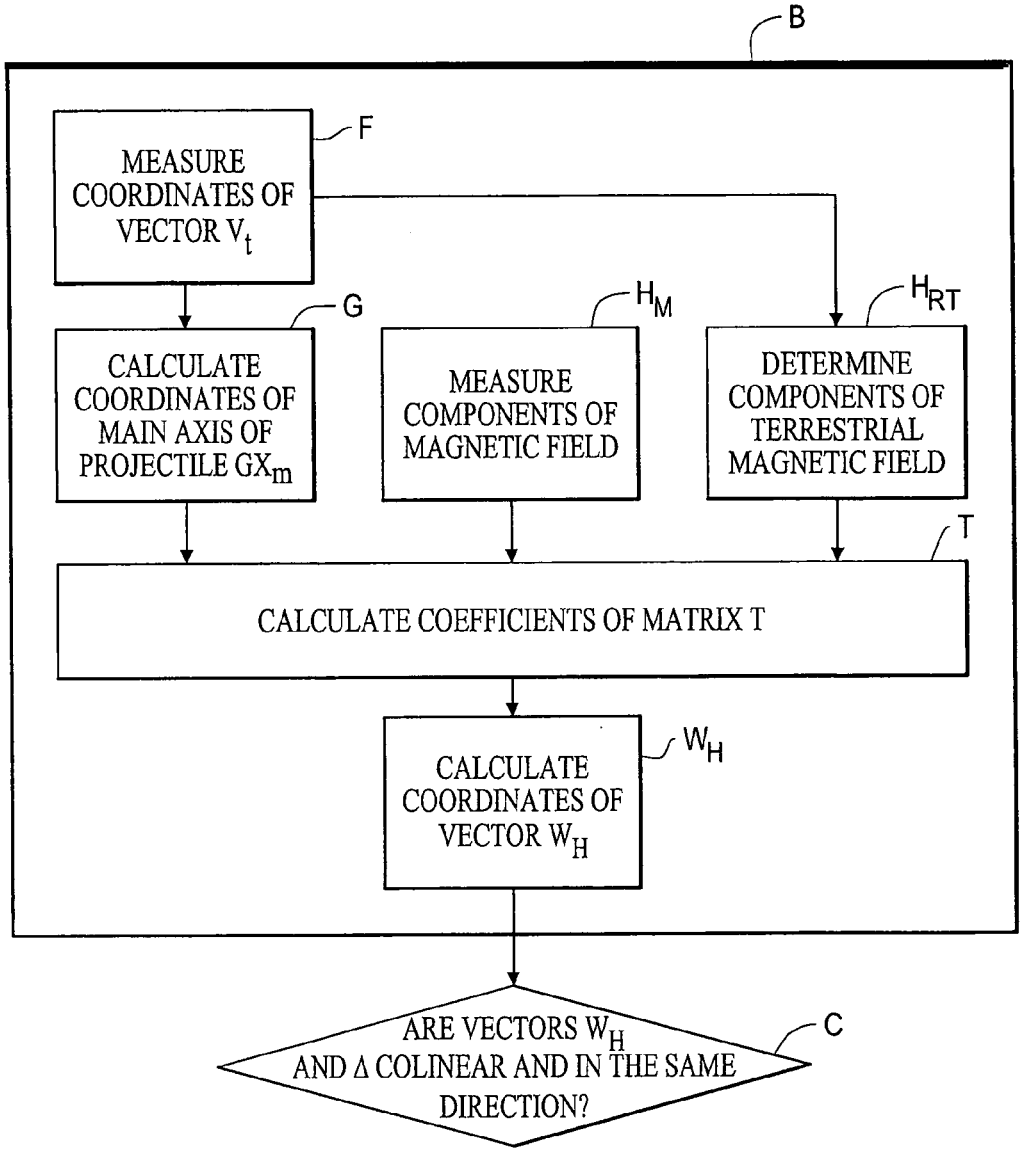

FIG. 5 is a logical diagram which thus details step B which corresponds to the calculation of the coordinates of Vector $W_H$ (orientation of the direction of action) in the fixed terrestrial reference 4.

Block F corresponds to the measurement by the positioning means 11, in the fixed terrestrial reference 4, of the coordinates of vector Vt associated with the different points of the trajectory 5 located as well as to the calculation by derivation (or else by determination of the curve radius of the trajectory) of the accelerations to which the projectile is subjected.

Block G corresponds to the calculation of the coordinates in the fixed terrestrial reference 4 of the main axis of the projectile GXm. This calculation implements the calculations from Block F as well as the aerodynamic transfer function (FTa) of projectile 2.

Block HM corresponds to the measurement by sensors 14 of the components of the magnetic field in the reference of the projectile 2. Block $H_{RT}$ corresponds to the determination (by reading in the memories or register of the computer 7) of the components of the terrestrial magnetic field in the terrestrial reference at the point under consideration of the trajectory. In FIG. 5 this block is linked to Block F to act as a reminder that the memory of the magnetic field data must be read with reference to the coordinates of the point under consideration on the projectile's trajectory (such coordinates supplied by the positioning means 11).

Block T is the one which calculates the coefficients of the matrix T enabling the transition of a reference linked to the projectile to a fixed terrestrial reference.

Block $W_H$, lastly, corresponds to the calculation of the coordinates of the direction of action vector $W_H$ with respect to the fixed terrestrial reference 4.

According to a particular embodiment, the invention may advantageously be implemented in an attack module constituted by a sub-projectile scattered above a zone of ground by a carrier, for example an artillery cargo shell, drone or rocket (not shown).

Such sub-projectiles are well known to someone skilled in the art.

Figure 6:
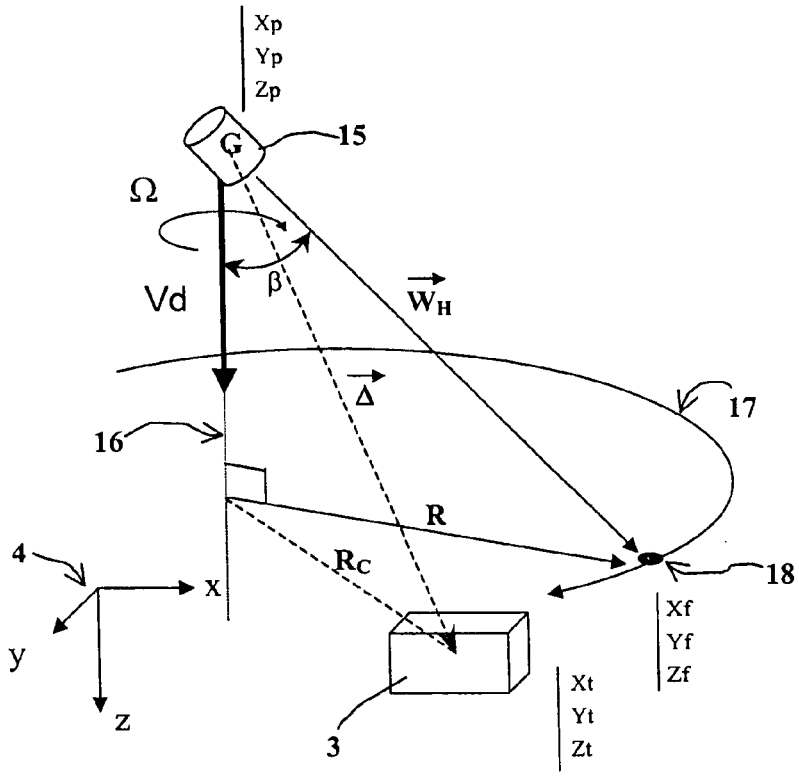
FIG. 6 shows a particular embodiment according to which a sub-projectile is used that has a downward movement above a zone of ground and follows a substantially vertical axis.

FIG. 6 schematically shows such a sub-projectile 15. It has a downward movement following a substantially vertical axis 16 as well as a spin movement (rate Ω) around this vertical fall axis.

The direction of action $W_H$ is inclined with respect to the vertical axis 16 by a given angle β which is fixed by construction.

Thus, as the sub-projectile 15 falls, its direction of action $W_H$ sweeps the ground in a spiral 17 whose radius R is reduced along with the altitude Zp of the sub-projectile 15.

FIG. 6 shows the coordinates of the different points in a fixed terrestrial reference 4.

(XpYpZp) are the coordinates of the sub-projectile 15.

(XtYtZt) are the coordinates of the target 3.

(Xf, Yf, Zf) are the coordinates of the point of intersection with the ground of the direction of action vector $W_H$ of the sub-projectile 15. This point corresponds to the theoretical point of impact 18 on the ground of the slug or the splinter spray generated when the sub-projectile 15 is ignited.

The radius R is linked to the altitude Zp of the sub-projectile 15 by the trigonometric relation R=Zp.tan(β).

FIG. 6 shows the vector Δ (attack module/target distance vector).

The coordinates of this vector are easily calculated from the coordinates (Xp, Yp, Zp) of the sub-projectile 15 (measured by the positioning means 11) and those (Xt, Yt, Zt) of the target 3 (programmed before firing).

As for the previous embodiment, the norm of this vector Δ will be the value of a distance between the attack module and target.

In accordance with the invention, any collinearity of the vectors $W_H$ and Δ will be checked for in order to authorize initiation (the vectors must naturally also have the same direction).

In the particular case of a sub-projectile falling vertically and spinning, when vectors $W_H$ and Δ are collinear they also have the same norm.

In this case it is generally not necessary to implement a radius of action condition to be respected for distance Δ. Indeed, the operational distance of action of known sub-projectiles is large enough (several hundred meters) for terminal effectiveness on the target to be ensured. Test D (FIG. 4) is therefore pointless.

In certain cases, for example when sub-projectiles are scattered at a great distance from the ground (over 800 m), a complementary test to the measurement of the collinearity of vectors $W_H$ and Δ may be provided. This test will enable a verification that the value of the norm of vector Δ is effectively less than or equal to a predefined radius of action Ra.

Alternatively, a test may be performed at the altitude at which the sub-projectile is with respect to the ground (by using an altimeter).

The vertical fall of the sub-projectile enables the implementations of the process according to the invention to be significantly simplified.

Indeed, the sub-projectile follows a vertical trajectory and is subjected to no lateral acceleration. It is in this case easy to lift the indetermination in the calculation of the transition matrix T enabling a transition of the reference linked to the sub-projectile to the terrestrial reference. For this, the axis GZm of the reference linked to the projectile merely has to be considered as being vertical. The coordinates of axis GZm in the terrestrial reference are easily known from the simple determination of the coordinates of point G (data provided by the positioning means 11).

Figure 7:
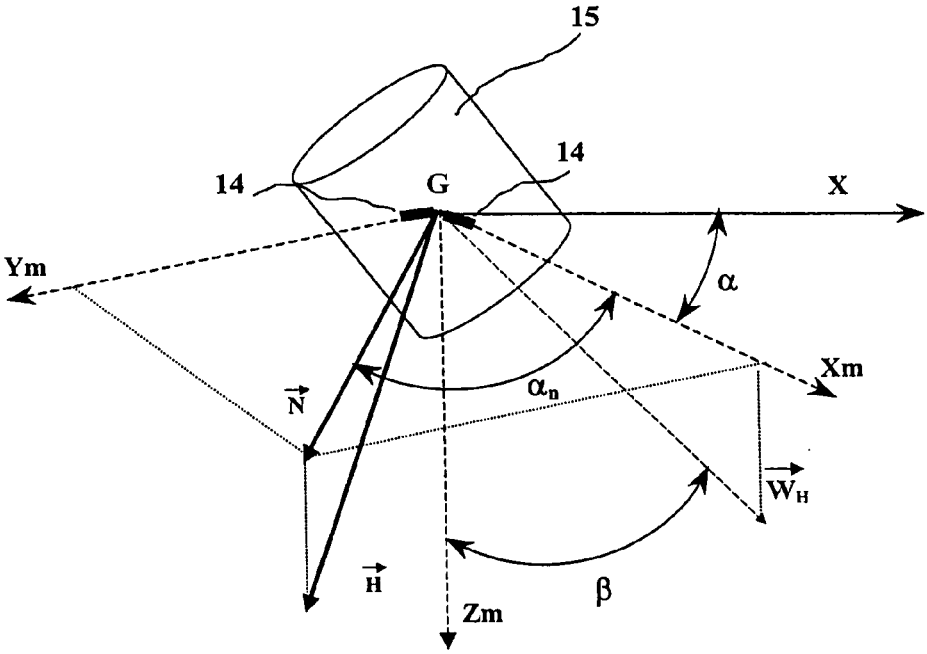
FIG. 7 is a more detailed view of the sub-projectile that enables the different axes, angles and vectors to be referenced.

FIG. 7 shows the sub-projectile 15 as well as the positioning of two sensors 14 of the magnetic field.

The reference GXmYmZm linked to the sub-projectile 15 has a privileged axis GZm which is the vertical axis.

The magnetic sensors 14 are arranged in the sub-projectile so as to materialize two directions GXm and Gym which define a horizontal plane as the sub-projectile falls (such plane being perpendicular to the direction GZm).

Given the sub-projectile's 15 geometry, it is easy to control the position of the sensors 14 so that they define such a plane as the sub-munition falls.

Here, an orthonormed reference has been defined but any other reference would be possible on condition that the plane GXmYm remains orthogonal to the vertical GZm.

As in the previous embodiment, the location of the direction of action $W_H$ with respect to the sub-projectile, and thus to the sensors 14, is a fixed construction datum.

It is thus easy to determine the orientation of the direction of action $W_H$ in the fixed terrestrial reference 4 from the measurement of the magnetic field components in the plane GXmYm and the knowledge of the components of this field in the fixed terrestrial reference, at the measurement point under consideration, such as they have been memorized before firing.

The transition matrix T enabling the transition in the reference is thus easily determined. Such determination is all the easier in that, with the choice of a reference linked to the projectile and incorporating a vertical axis and a horizontal plane, it is enough to know a single Euler angle, spin angle α enabling a transition between the fixed terrestrial axis GX (centered on G in the sub-projectile 15) to axis GXm, to determine the orientation in the terrestrial reference of the sub-projectile 15 (and thus its direction of action $W_H$).

Two magnetic sensors 14 are enough to calculate the value of angle αn formed by the projectile N of the magnetic field vector with axis GXm. Angle α can be deduced from the knowledge of the coordinates of the magnetic field in the terrestrial reference. In fact, a single sensor would be enough, in principle, however, given the measurement errors of a magnetic sensor, two sensors are required to be used.

Such a configuration is simpler than that described previously where it was necessary to measure three components of the terrestrial magnetic field.

FIG. 7 shows the terrestrial magnetic field vector H as well as its projection N on the plane GXmYm defined by sensors 14. Angle αn separates axis GXm and vector N in this same plane.

Figure 8:
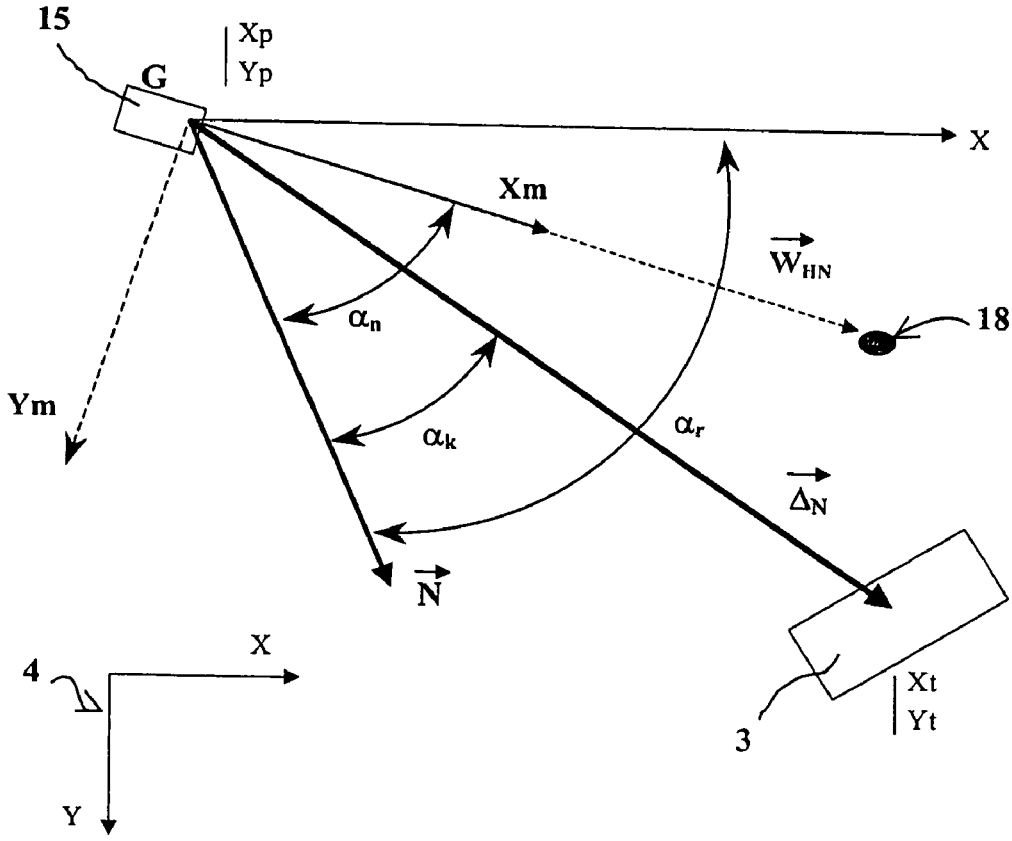
FIG. 8 is an analogous view to that in FIG. 7 but in which the vectors are shown in projection on a horizontal plane.

By way of non-limiting example, FIG. 8 shows how it is possible for the orientation of the direction of action $W_H$ to be easily calculated and the conditions authorizing the initiation of the attack module, or not, to be verified.

With this embodiment of the invention, it is judicious for the different calculations to be performed in the horizontal plane GXmYm.

FIG. 8 thus shows the different vectors in projection in the horizontal plane. Axis GXm of the reference linked to the sub-projectile 15 has been chosen at random to be the same as the projection $W_{HN}$ of the direction of action $W_H$ in this plane.

Such an arrangement is convenient for the simplification of the equations and physically corresponds to a specific positioning of the sensor 14 with respect to the direction of action $W_H$. It is naturally possible, in practical terms, for axes $W_{HN}$ and GXm not to be the same. What is important is to know the relative position of these two directions (such position being a fixed construction datum of the sub-projectile 15).

Reference $\alpha r$ is given to the angle made (in the horizontal plane) by the projection N of the magnetic field vector H with respect to the axis GX of the fixed reference. This value is deduced from the coordinates of the magnetic field in the terrestrial reference such as pre-programmed for the point G under consideration of the trajectory. We can see that it is possible and sufficient in this case to memorize in the computer means 7 only the $\alpha r$ angles and not the full components of the magnetic field vector.

The angle $\alpha n$ formed by the projection N of the magnetic field vector with axis GXm is measured using the sensors 14.

Vector $\Delta_N$ (projection of the vector linking the sub-projectile 15 to the target 3) is easily determined from the coordinates Xp, Yp of the sub-projectile (given by the positioning means 11 and those Xt, Yt of the target 3 (pre-programmed).

The norm of vector $\Delta_N$ is such that:

$$\Delta_N^2=(Xt-Xp)^2+(Yt-Yp)^2$$

And angle $\alpha k$ between vector N and vector $\Delta_N$ is calculated from the pre-programmed value of the angle $\alpha r$ for the point under consideration and the coordinates of the sub-projectile 15 and the target 3 by:

$$\alpha k=\alpha r-\tan \text{arc}\ [(Yt-Yp)/(Xt-Xp)]$$

Since the tangent arc is defined on ±n/2, classical algorithms will naturally be used which allow any doubts to be lifted regarding the value of the arc calculated.

With the calculation simplifications thus presented, we can see that the condition in which the initiation is authorized if the vector $W_H$ and $\Delta$ are collinear in the same direction is translated by:

1. the verification of an equality of angle condition:

$\alpha k=\alpha n \rightarrow$ the vectors $W_H$ and $\Delta$ are in a same vertical plane, 2. the verification of an equality of length (in projection in the horizontal plane):

$W_{HN}=\Delta_N$ of vector $\Delta$ on the horizontal plane is a constant Rc (see FIG. 6) which is calculated on trajectory depending on the relative coordinates of the sub-projectile and the target.

We note furthermore that regardless of its orientation, length $W_{HN}$ which has previously been described with reference to FIG. 6, can be easily calculated from the altitude of the sub-projectile 15:

$$W_{HN}=R=Zp.\tan(\beta).$$

By way of controlling the measurement, it is thus possible for an altimeter to be implemented (for example one using laser technology) to measure Zp and verify the calculated value of the norm of $W_H$.

By way of numerical application, if the invention is implemented for a sub-projectile 15 which has a drop rate of 45 meters per second, a spin rate of 15 revs per second and an angle of inclination of its direction $W_H$: $\beta=30°$, with a firing initiation altitude of 100 meters, a firing accuracy (equiprobable radius):CEP=6 meters.

Such a result is obtained with standard deviations on the GPS 11 positioning measurements of approximately 3 m, a standard deviation on the calculated angles of approximately 2°, and a standard deviation on the altitude of approximately 5 meters.

The firing accuracy is remarkable since the sub-projectile 15 has absolutely no target detection means.

By way of a variant, the process according to the invention may be implemented for at attack module which is already fitted with target detection means, for example an infrared sensor.

In this case, step E in FIG. 4 will be followed by another test which will correspond to the verification of the presence of a target having the expected infrared characteristics (such detection means are classical and are already being implemented today).

The process according to the invention in this case does not control the initiation itself but provides an additional condition to the simple detection of a target.

It is thus possible to ensure, whatever the potential targets present on the ground, that the initiation of the attack module will only be produced in the direction of a well determined zone of ground programmed before firing or on trajectory.

The operational safety of attack modules is thereby improved and the collateral effects of the attacks are limited.

Other embodiments are possible without departing from the scope of the invention. It is thus possible for the invention to be implemented for an attack module incorporating several directions of action $W_H$. For example, attack modules incorporating multi-mode charges that are programmed before firing or on trajectory. The calculations described previously may be performed for several directions of action for a given attack module. It merely requires the operational direction of action to be defined, and thus the direction to which the firing authorization conditions permitted by the invention must be applied.

The examples described referred to the determination of a direction of action $W_H$ whose intersection on the ground is pinpointed. It is naturally possible, in particular when the attack module incorporates a splinter charge, to determine, in addition to the mean orientation of vector $W_H$, the value of the area on the ground which is covered by the spray of splinters. This area is easy to calculate by introducing into the projectile or sub-projectile, the value of the cone angle of the spray of splinters generated (solid angle centered on direction $W_H$).

In this case, during the initial programming of the attack module, the coordinates of a surface area on the ground where firing is authorized could be entered rather than the coordinates of a pinpointed target.

The previously described algorithm will in this case enable the verification to be made whether or not the spray of splinters generated is effectively within the authorized firing area or not.

What is claimed is:

1. A process to control an initiation of an attack module, said such attack module having at least one pre-determined direction of action ($W_H$), wherein said process has the following steps:

(i) before firing or on trajectory, coordinates of at least one target are determined in a fixed terrestrial reference, and (ii) an orientation of each of the at least one pre-determined direction of action ($W_H$) in said fixed terrestrial reference is determined at least once on trajectory, (iii) the initiation of said attack module is only authorized if the at least one pre-determined direction of action is oriented in a direction toward said target.

2. The process to control the initiation of an attack module according to claim 1, wherein the determination of the orientation of the at least one pre-determined direction of action ($W_H$) with respect to said fixed terrestrial reference is made by measuring the orientation of said attack module with respect to at least two components of a terrestrial magnetic field, the components of the terrestrial magnetic field being previously known in said fixed terrestrial reference.

3. The process to control the initiation of an attack module according to claim 1, wherein a measurement of a distance of said attack module and said target is made based on a coordinate ($X_tY_tZ_t$) of said target in said fixed terrestrial reference, programmed before firing or on trajectory, and measurements are made of a coordinate ($X_pY_pZ_p$) of said attack modules in said fixed terrestrial reference, such measurements being made on trajectory by a satellite positioning system or else transmitted to said attack module by a platform having trajectography means.

4. The process to control the initiation of an attack module according to claim 3, the process controlling an initiation of a firing of a projectile with a non-vertical trajectory, wherein the coordinates of an attack module/target vector (Δ) are calculated on trajectory and in said fixed terrestrial reference, such computation being made from a pre-programmed coordinate ($X_tY_tZ_t$) of a pre-programmed target as well as the coordinate ($X_pY_pZ_p$) measured of said attack module and using a tri-axial magnetic compass the orientation of the at least one pre-determined direction of action ($W_H$) of said attack module is determined in said fixed terrestrial reference.

5. The process to control the initiation of an attack module according to claim 4, wherein, to determine an orientation of the at least one pre-determined direction of action ($W_H$) of said attack module in said fixed terrestrial reference, a coefficient of a transition matrix (T) from a reference linked to said attack module to said fixed terrestrial reference, these components being calculated by associating, for points of the trajectory under consideration, a measurement of components ($H_{Xm}$, $H_{Ym}$, $H_{Zm}$) of said terrestrial magnetic field in a reference linked to said attack module and a value of components ($H_X$, $H_Y$, $H_Z$) of the magnetic field in said terrestrial reference, a value of the components being known and pre-programmed in said attack module, an indetermination of the computation being lifted by a determination of at least one direction in said terrestrial reference of one of the axes of a reference linked to said attack module.

6. The process to control the initiation of an attack module according to claim 5, wherein, to lift the indetermination, an orientation of a longitudinal axis (GXm) of said attack module is calculated from a computation of angle of said projectile of incidence (Inc), said computation being made using measurements of the trajectory followed, a velocity (Vt) in said terrestrial reference, as well as a knowledge of an aerodynamic transfer function of said projectile.

7. The process to control the initiation of an attack module according to claim 1, the process controlling an initiation of a firing of a sub-projectile scattered about a zone of ground by a carrier and to which a downward movement following a substantially vertical axis and a spin movement around the descending vertical axis have been imparted, wherein the at least one pre-determined direction of action ($W_H$) is inclined with respect to the vertical axis of a given angle (β), wherein the orientation of each of the at least one pre-determined direction of action ($W_H$) in said fixed terrestrial reference is determined using a measurement of the components of the magnetic field in a horizontal plane, said plane defined by two magnetic sensors carried by said attack module, the orientation of each of the at least one pre-determined direction of attack ($W_H$) with respect to said plane being known and the orientation of the magnetic field in said fixed terrestrial reference also being known.

8. The process to control the initiation of an attack module according to claim 7, wherein target detection means are implemented in said attack module and wherein said attack module will only be initiated if a condition for authorization has been fulfilled and that a target has effectively been detected.

9. An initiation control device for an attack module which has at least one pre-determined direction of action, and which implements the process according to claim 1, said device comprises means facilitating memorizing the coordinates in a fixed terrestrial reference of at least one target, means facilitating measurement of the coordinate ($X_pY_pZ_p$) of said attack module in said fixed terrestrial reference, as well as a computation means facilitating determining the orientation on trajectory of the direction of action of said attack module in said fixed terrestrial reference and incorporating means to initiate the attack module being coupled with said computation means so as to authorize initiation only if the at least one pre-determined direction of action ($W_H$) is oriented in the direction of said target.

10. The initiation control device for an attack module according to claim 9, wherein said means to measure the coordinates of said attack module in said fixed terrestrial reference comprises at least one of a GPS receiver and a receiver for location data transmitted by a remote platform.

11. The initiation control device for an attack module according to claim 9, wherein said device comprises at least two fixed magnetic sensors to determine the orientation of the at least one predetermined direction of action of said attack module with respect to said terrestrial magnetic field, a memory means supplying the components of the terrestrial magnetic field in said fixed terrestrial reference.

12. The initiation control device for an attack module according to claim 11, the initiation control device being adapted to initiate firing a projectile with a non-vertical trajectory, wherein said attack module incorporates at least three magnetic sensors and the memory means determining values of said terrestrial magnetic field in a fixed terrestrial reference for the different points of said trajectory, the computation means to determine the orientation of the reference linked to said attack module with respect to said terrestrial reference using the different values of the terrestrial magnetic field, as well as the coordinates of said attack module/target in said fixed terrestrial reference, and those of the at least one pre-determined direction of attack ($W_H$) of said attack module.

13. The initiation control device for an attack module according to claim 11, the initiation control device being adapted to initiate firing a sub-projectile that is scattered above a zone of ground by a carrier and which has a downward movement after scattering with a substantially vertical axis as well as a spin movement around this vertical axis, wherein the at least one pre-determined direction of action ($W_H$) is inclined with respect to a vertical axis of a given angle (β), device wherein said attack module incorporates at least two magnetic sensors arranged along two axes (GXm, GYm) of a reference linked to said attack module, said two axes defined by said sensors thereby determining a plane which is perpendicular to a planned vertical fall axis, the orientation of the at least one pre-determined direction of action ($W_H$) of said attack module with respect to this horizontal plane being known.

* * * * *